United States Patent [19]

Gillett et al.

[11] Patent Number: 4,542,950

[45] Date of Patent: Sep. 24, 1985

[54] ZERO INSERTION FORCE EDGE CONNECTOR WITH WIPE CYCLE

[75] Inventors: John B. Gillett, Kingston; John A. Miraglia, West Hurley, both of N.Y.

[73] Assignee: International Business Machines Corporation, Armonk, N.Y.

[21] Appl. No.: 581,529

[22] Filed: Feb. 21, 1984

[51] Int. Cl.[4] ..... H01R 13/631

[52] U.S. Cl. ..... 339/75 MP; 339/176 MP

[58] Field of Search ..... 339/74 R, 75 M, 75 MP, 339/176 MP

[56] References Cited

U.S. PATENT DOCUMENTS

| | | | |
|---|---|---|---|
| 4,076,362 | 2/1978 | Ichimura | 339/75 MP |
| 4,178,053 | 12/1979 | Eifort | 339/75 MP |
| 4,189,200 | 2/1980 | Yeager et al. | 339/75 MP |
| 4,266,839 | 5/1981 | Aikens | 339/75 MP |
| 4,270,826 | 6/1982 | Narozny | 339/75 MP |
| 4,357,066 | 11/1982 | Cairns et al. | 339/176 MP |
| 4,428,635 | 1/1984 | Hamsher, Jr. et al. | 339/176 MP |

OTHER PUBLICATIONS

IBM Technical Disclosure Bulletin, vol. 14, No. 9, Feb. 1972, "Twin-Contact Connector", Colletti et al.

*Primary Examiner*—John McQuade

*Attorney, Agent, or Firm*—Mark F. Chadurjian; Barbara A. McDowell; Edwin Lester

[57] ABSTRACT

A ZIF connector block for establishing an electrical connection between the I/O pads of an edge-connected printed circuit board and a set of printed conductors. The connector has two opposing rows of contacts. The contacts are of two different lengths, both adjacent and opposite ones of the contacts having different lengths. An upper housing has a plurality of cams mounted thereon, each cam having a different cam surface profile. The surface profiles of the cams are staggered into two different lengths corresponding to the lengths of the contacts so that when the cams are actuated by imparting a vertical motion to the upper housing, the contacts will simultaneously engage the I/O pads in a staggered fashion. Moreover, the surface profiles of the cams are constructed so that after simultaneous engagement, the contacts perform sequential wipe cycles on the pads. The staggered and sequential wipe cycles promote the stability of the board within the connector without sacrificing electrical integrity.

26 Claims, 12 Drawing Figures

| | | | | | | | | | |
|---|---|---|---|---|---|---|---|---|---|
| 5X | 4Y | 3X | 2Y | 1X | 1Y | 2X | 3Y | 4X | 5Y |
| 5Y | 4X | 3Y | 2X | 1Y | 1X | 2Y | 3X | 4Y | 5X |

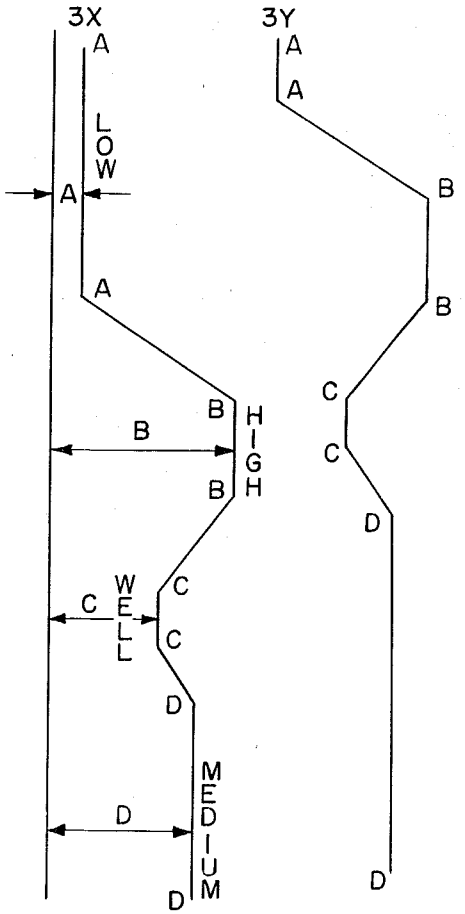
FIG. 4a.
FIG. 4b.
3X
3Y
LOW
HIGH
WELL
MEDIUM
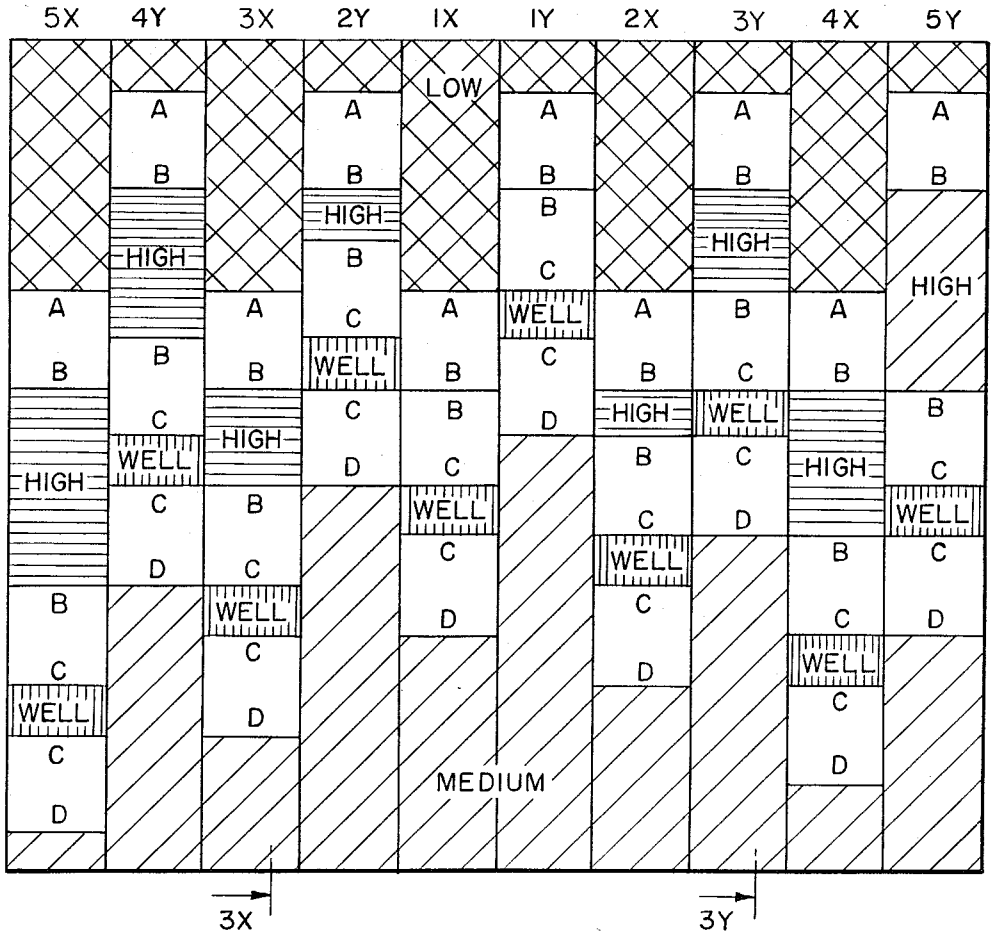
FIG. 3
5X
4Y
3X
2Y
1X
1Y
2X
3Y
4X
5Y
LOW
HIGH
WELL
MEDIUM
3X
3Y

ZERO INSERTION FORCE EDGE CONNECTOR WITH WIPE CYCLE

Description

1. Technical Field of the Invention

The subject invention relates generally to zero insertion force connectors for printed circuit boards having means for wiping the contacts of the connector against the I/O pads of the printed circuit board in order to ensure electrical contact therebetween.

2. Background Art

The use of connector blocks to establish electrical contact between the I/O pads of a printed circuit board and external signal and/or power sources is well known in the art. A connector block typically comprises an outer housing of an electrically nonconductive material and a plurality of contact wires disposed within the housing. The contact wires are arranged into two opposing rows of contact pairs which engage the I/O pads disposed on opposite sides of the printed circuit board.

In a conventional connector block, the spacing between the contact wire rows is set such that the wires immediately contact the printed circuit board upon insertion. This immediate contact produces a force opposing the further insertion of the printed circuit board into the connector block. Thus, as the number of I/O ports on the printed circuit board (and the number of contact wires) increases, it becomes increasingly difficult to insert the printed circuit board into the connector block. Zero insertion force (ZIF) connector blocks overcome this difficulty by setting the spacing between the contact wire rows such that the wires do not immediately contact the printed circuit board. In such ZIF connector blocks the contact wires are brought into abutment with the I/O pads of the printed circuit board only after the board has been completely inserted into the connector block.

A problem which typically occurs in connector block technology is the degradation of the electrical contact between the contact wires of the connector block and the I/O pads of the printed circuit board. For example, this degradation can be produced by dust buildup on the I/O pads. In the above-described conventional connector blocks, this problem is inherently addressed. Specifically, as the printed circuit board is inserted between the contact wire rows, the wires frictionally engage the I/O pads to remove dust and/or other nonconductive debris. This so-called "wiping cycle" process has been quite satisfactory in greatly reducing contact degradation. However, since there is no frictional engagement between the I/O ports and the contact wires of a ZIF connector block while the printed circuit board is inserted into the block, the above-described wiping cycle process cannot be used.

Thus a need has arisen to modify ZIF connector blocks so that their contact wires can complete wiping cycles. In attempting to formulate the above-described modification, we noticed that the stability of the printed circuit board within the block was reduced by these wiping cycles. That is, if all of the contact wires complete similar wipe cycles at the same time, the printed circuit board tends to move with the contact wires, and no frictional wiping occurs. This problem is especially troublesome in connector blocks having a high number of contact wires, and where the weight of the printed circuit board is relatively low.

U.S. Pat. No. 4,189,200 (granted Feb. 19, 1980 to Yeager et al) discloses a ZIF connector block. The contacts of the Yeager connector block are sequentially cam-actuated for engagement with an edge of a printed circuit board. More specifically, the contacts are actuated at different times by means of a cam and a drive member having a set profile.

U.S. Pat. No. 4,266,839 (issued May 12, 1981 to Aikens) discloses a sequentially actuated ZIF connector block. A "toggle rod" is connected to the free ends of the contact wires. After the printed circuit board is inserted into the Aikens connector block, the toggle rod is rotated, forcing the contact wires into sequential engagement with the I/O pads of the printed circuit board. Subsequently, upon further rotation of the toggle rods, the contact wires move along the surface of the I/O pads completing a wiping cycle thereon.

U.S. Pat. No.4,076,362 (issued Feb. 28, 1978 to Ichimura) discloses a ZIF connector block having means for sequentially engaging the I/O pads of a printed circuit board. A slider is slideable longitudinally along the connector. The slider has a channel cut therein which communicates with a projection from a cam member abutting a contact wire. As the slider slides past the cam member, the cam member projection engages the channel of the slider, causing the cam member to move upward. The cam surface of the cam member engages the contact wire, forcing the contact wire inwardly to engage the printed circuit board.

As described above, the art shows sequential actuation of ZIF connector block contacts. Moreover, the art also teaches the use of a wiping cycle to clean the I/O pads of the printed circuit board inserted into a ZIF connector block. However, a need has arisen in the connector block art for a ZIF connector having contact wires which complete wipe cycles on opposite sides of the printed circuit board without adversely affecting the stability of the board within the block. Heretofore, such a connector block has not been disclosed or taught in the art.

DISCLOSURE OF THE INVENTION

It is thus an object of the present invention to provide an improved zero input force connector block.

It is a further object of the invention to provide a ZIF connector with means for completing a wipe cycle while also promoting the stability of the printed circuit board within the connector without the use of external support structures.

These and other objects of the invention are realized by the provision of a contact actuating member which abuts the contact wires of a zero input force connector block. The contact-actuating member comprises an upper housing mounted on a moveable linear cam. The horizontal displacement of the linear cam imparts a vertical displacement to the upper housing. The upper housing has a plurality of contact cams thereon. The contact cams are arranged in a single row (or two facing rows) disposed behind the contact wires such that each contact cam abuts one of the contact wires of the connector block. The surface profiles of the contact cams are constructed such that the contact wires contact the I/O ports on opposite sides of the printed circuit board, and then perform sequential wipe cycles on the I/O pads at different points thereon (i.e., producing staggered wipe cycles).

A feature of the invention is the surface profiles of the contact cams. Opposing contact cams (i.e., contact cams at the same position along the opposing contact cam rows) have staggered surface profiles. Furthermore, the surface profiles of adjacent contact cams are also staggered. Thus, any given contact cam has a surface profile which is different from (i.e., relatively staggered with respect to) the surface profiles of both its opposite and the immediately adjacent contact cams. This feature promotes the stability of the printed circuit board within the connector block by producing staggered wipe cycles (i.e., the cycles of both the opposite and the immediately adjacent contact wires produce forces which tend to oppose each other). Moreover, the surface profiles are constructed such that adjacent contact wires perform sequential wipe cycles.

BRIEF DESCRIPTION OF THE DRAWINGS

The structure and teachings of the present invention will become more apparent upon a detailed description of a preferred embodiment thereof. In the description to follow, reference will be made to the appended drawings, in which:

FIG. 3 schematic view of the contact cams of the invention;

FIGS 4*a* and 4*b* are side views of two contact cams of the invention;

BEST MODE FOR CARRYING OUT THE INVENTION

Figures 1, 5:
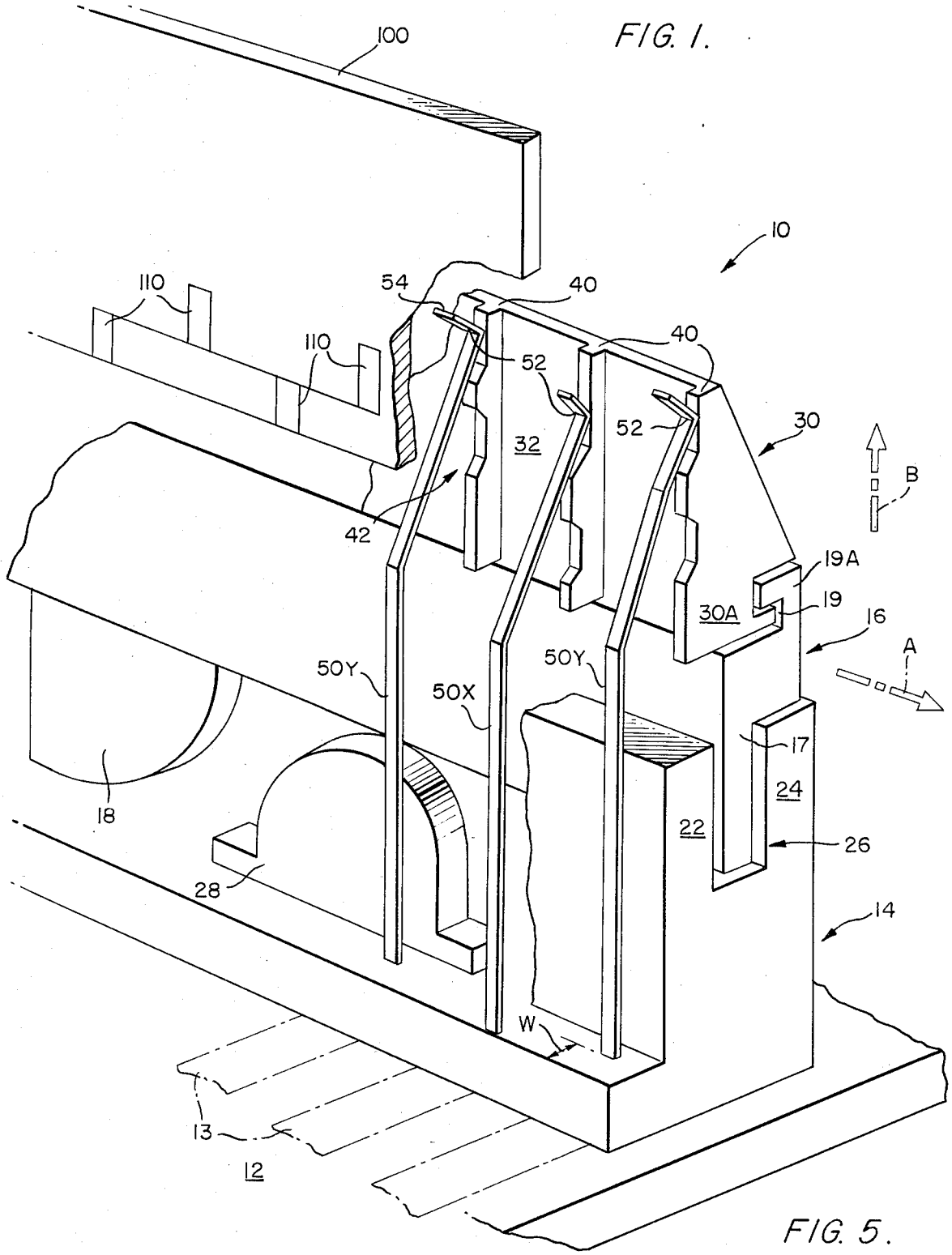
FIG. 1 is a cut away view of a preferred embodiment of the invention.
FIG. 5 is an explanatory diagram illustrating the relative positions of the contact cams along opposing contact cam rows.

With reference to FIG. 1, a cut-away view of a connector block 10 is shown. It is to be understood that, while FIG. 1 shows one row of contact wires, the description to follow is also applicable to a connector having two facing rows of contacts defining a series of opposing contact wires which receive a printed circuit board therebetween. Contact wires 50 extend through a lower housing 14 into holes cut into a substrate 12. The walls of the holes in substrate 12 are plated with a conductive strip 13 which extends beyond lower housing 14 to establish contact between external electrical devices and contact wires 50. The contact wires are soldered to the holes in substrate 12.

A linear cam 16 having cam lobes 18 on a bottom portion 17 is mounted for linear motion (in the direction of arrow A) along lower housing 14. More specifically, lower housing 14 has projections, 22, 24 which define a guideway 26 therebetween. Bottom portion 17 of linear cam 16 is disposed within guideway 26. Lower housing 14 is further provided with a cam follower 28, a portion of which is disposed within guideway 26. Thus, when linear cam 16 is displaced horizontally within guideway 26, the cam followers 28 of lower housing 14 cams against the cam lobes 18 to impart a vertical displacement to linear cam 16.

A cam carriage (hereinafter "upper housing") 30 is mounted on the linear cam 16. Specifically, upper housing 30 is mounted for movement on a carriage guideway 19 defined by a hook-shaped member 19A projecting from the upper surface of linear cam 16. A C-shaped portion 30*a* of upper housing 30 loosely engages hook-shaped portion 19A to maintain upper housing 30 on carriage guideway 19. Note that the upper housing 30 is surrounded by lower housing 14, restricting the upper housing to vertical movement. For the sake of clarity, the portion of lower housing 14 which surrounds upper housing 30 is not shown. Note further that upper housing 30 comprises two facing sides (only one of which is shown in FIG. 1) defining an elongated slot through which the printed circuit board is inserted.

A plurality of contact cams 40 are mounted on and project from the inwardly-facing surface 32 of upper housing 30. The contact cams 40 have distinct camming surface profiles 42, which will be described in more detail hereinafter. The contact cams 40 cam against contact wires 50. Contact wires 50 comprise cam-engaging portions 52 and end portions 54. End portions 54 of contact wires 50 establish an electrical contact with I/O pads 110 of printed circuit board 100. Note that contact wires 50 project through lower housing 14 to communicate with external electrical conductors. For example, contact wires 50 could communicate with conductors 13 printed on the surface of substrate 12. Contact wires 50 are of different lengths; that is, the contact wires along each row alternate between a first contact wire 50X of a length X and a second contact wire 50Y of a length Y as shown in FIG. 1.

The contacts are arranged into two opposing rows (the other row is not shown in FIG. 1) such that a contact 50Y on one row is disposed opposite a contact 50X on the other row. Thus, the two rows of contacts can be thought of as a series of opposing contact pairs, where each "pair" has contact wires of lengths X and Y. The contact wires are mounted at varying angles with respect to the upper housing 30; that is, although the contact wires 50X are displaced by a distance W with respect to contact wires 50Y, the portions 52 of contacts 50X and 50Y are in alignment. This is done in order to vary the force with which the contacts engage the printed circuit boards.

The general operation of the connector block of the invention will now be described with reference to FIGS. 1 and 2A–2F. When linear cam 16 is in the position as shown in FIG. 1, portion 52 of a contact wire 50 engages the upper-most portion of a contact cam 40. As shown in FIG. 2A, the contact wire abuts contact cam 40 at its lowest surface AA. At this point, the contact wires are maintained at a position removed from I/O pads 110 of printed circuit board 100. As the linear cam 16 is moved horizontally (i.e., in the direction of arrow A) the cam follower 28 cams against the cam rods 18, imparting a vertical motion (in the direction of arrow B) to the upper housing 30. Thus, as shown in FIGS. 2B–2F, the contact cam 40 moves in an upward direction.

As shown in FIG. 2B, as the wire portion 52 abuts an upward ramp portion AB of contact cam 40, wire portion 54 is brought into contact with I/O pad 110 at a point 1. As wire portion 52 moves up ramp AB, contact portion 54 wipes the surface of the I/O pad 110 between point 1 and a point 2. As shown in FIGS. 2C and 2D, cam surface BB maintains the contact portion 54 at point 2 on I/O pad 110. As shown in FIG. 2E, when the cam portion 52 abuts downward-sloping trough surface BC of contact cam 40, the contact portion 54 wipes the surface of the I/O pad 110 between point 2 and a point 3 thereon. As cam portion 52 abuts upward-sloping trough surface CD, contact portion 54 wipes the surface of I/O pad 110 between point 3 and a point 4 thereof. Finally, as shown in FIG. 2F, as the cam portion 52 abuts surface DD of contact cam 40, the contact portion 54 is maintained in abutment at point 4 on I/O pad 110.

As described above, the present invention utilizes a plurality of contact cams to cause the contact wires of a ZIF connector block to complete a wipe cycle on the I/O pads of a printed circuit board.

Another feature of the invention will now be described with reference to FIGS. 3–5. FIG. 3 presents a schematic view of contact cams 40. Note that in FIG. 3 the contact cams are shown as being in abutment. That is, while the cams are shown in FIG. 1 as being in a spaced relationship, in FIG. 3 they are shown as being in an abutting relationship. The present invention encompasses both arrangements. In FIG. 3, ten different contact cams are shown. Each contact cam has a different camming surface profile, as described in more detail below.

Figure 2:
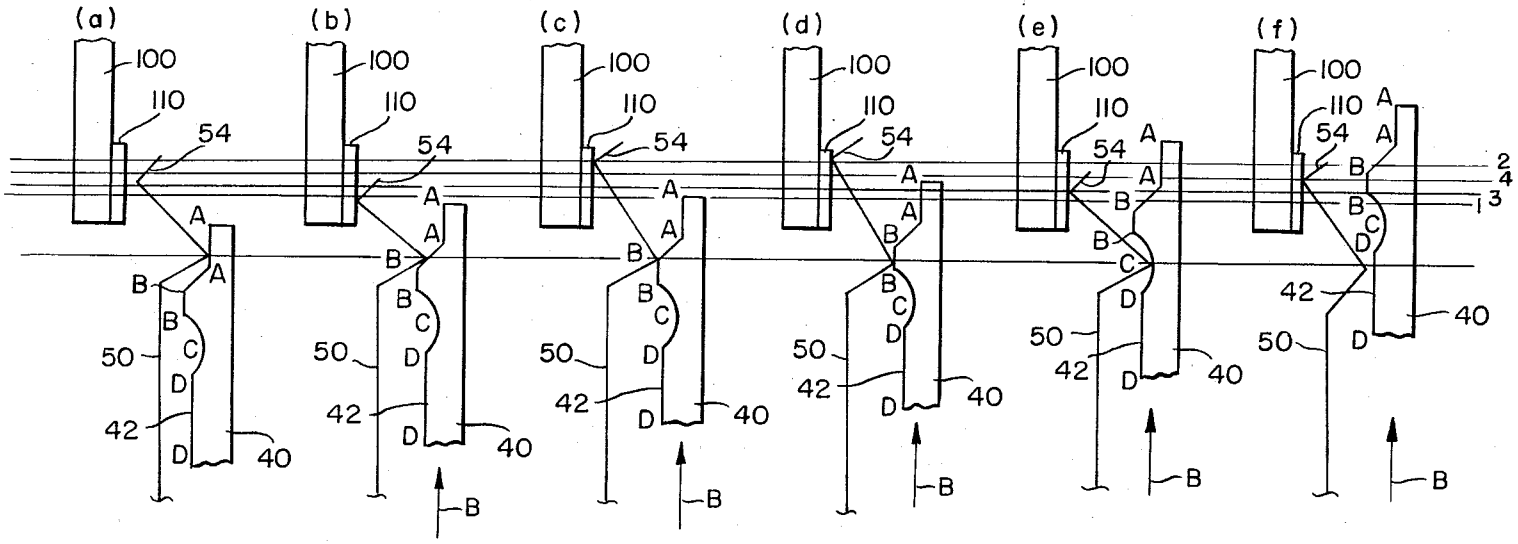
FIGS. 2A–2F are explanatory diagrams illustrating the wipe cycle of the contact wires of the invention.

The surface profiles of contact cams 3X and 3Y of FIG. 3 are shown in cross section in FIG. 4. At this juncture, a comparison between the cross-sectional profile of cam 3X in FIG. 4 and the schematic view of cam 3X in FIG. 3 will facilitate our discussion. As it is apparent upon comparison, the "LOW" portion of cam 3X in FIG. 3 corresponds to the profile area (or region) of the cam ("LOW" in FIG. 4) having a width A; region "A B" of cam 3X in FIG. 3 corresponds to the upward ramp AB of cam 3X of FIG. 4 having a width increasing from width A to a width B; region "HIGH" of FIG. 3 corresponds to the profile region of the cam ("HIGH" in FIG. 4) having a constant width B; region "B C" in FIG. 3 corresponds to the downward ramp BC in FIG. 4 having a width decreasing from width B to a width C; the region "WELL" of FIG. 3 corresponds to the profile region of the cam ("WELL" in FIG. 4) having a width C; the region "C D" in FIG. 3 corresponds to the upward ramp CD in FIG. 4 having a width increasing from width C to a width D; and the "MEDIUM" portion of cam 3X in FIG. 4 corresponds to the profile region of the cam ("MEDIUM" in FIG. 4) having a constant width D. Note that width D is less than width B (i.e., $A<C<D<B$). Note further that cam regions B-C-D in FIGS. 3 and 4 may have an arc-like (i.e., rounded) profile as shown in FIG. 2. Finally, note that, the length of the regions in FIG. 3 correspond to the portion of the contact cam which contains the given profile region shown in FIG. 4. For example, the length of region "HIGH" of cam 3X in FIG. 3 corresponds to the portion of the cam which has the profile region "HIGH" thereon (see FIG. 4).

As is now apparent in view of the above discussion, FIG. 3 shows a schematic view of the surface profiles of adjacent contact cams. Note that one difference between the surface profiles of adjacent contact cams is the length of the respective HIGH regions. That is, contact cams 5X and 5Y have longer HIGH regions than do contact cams 4X and 4Y, which have longer HIGH regions than contact cams 3X and 3Y, etc., down to the point where the HIGH region is extremely small in cams 1X and 1Y. Another difference between the surface profiles of adjacent contact cams is that all of the "X" contact cams have LOW regions of a first length while all of the "Y" contact cams have LOW regions of a second length smaller than the first length. Thus there are two types (X and Y) of contact cams defined by two different LOW region lengths, each of which has five similar varieties (1–5) defined by five different HIGH region lengths. It is to be understood that of the specific numbers of varieties and types discussed, as well as the regions which vary in length, are for the purposes of illustration and are not to be construed as being limitative on the invention.

Figure 6:
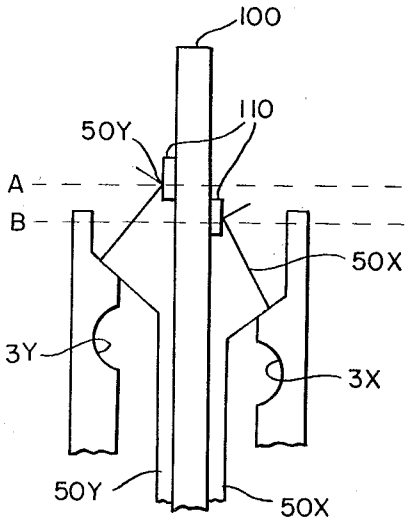
FIG. 6 is a side view of a selected pair of opposing contact wires engaging a printed circuit board therebetween.

As shown in FIG. 3, the above-described cam surface profiles are distributed along surface 32 of upper housing 30 in a specific pattern. First, the X cam types are disposed behind contact wires having a length X, and the Y cam types are disposed behind contact wires having a length Y (see FIG. 1). Thus, even though the contact wires are of different lengths, the profiles of the cams cause the wires to simultaneously abut the printed circuit board. Further, note that the I/O pads 110 on PCB 100 are staggered. That is, the I/O pads which are contacted by wires 50X are disposed below those which are contacted by wires 50Y, forming two staggered, aligned rows of pads. For example, with reference to FIG. 6, contact wires 50Y originally contact I/O pads at a point A as shown, while contact wires 50X originally contact the pads at a point B. The staggering of the contact wires and the I/O pads is done in order to increase the number of contacts per unit area of the printed circuit board. Contact cams of the same variety (e.g., 3X and 3Y) are disposed relatively opposite of each other to form opposing contact cam pairs. Since the cams are of the same variety, they will cause the contact wires to perform similar wipe cycles. More specifically, as shown in FIG. 6, since the positions of the wires are different (or staggered), the wires will perform staggered wipe cycles. Thus, the stagger of the staggered wipe cycles is created by both the differing contact wire lengths as well as the different lengths of the "low" regions of the cams.

With reference to FIG. 5, the contact cams are disposed on two contact cam rows which are separated by a gap through which the printed circuit board is inserted. Thus, no two contact cams on each contact cam row are alike. Each row of cams consist of the five varieties of cams both types, for a total of ten cams per row. The cams are distributed such that the first cam of the first row is the same as the tenth cam of the second row, the second cam of the first row is the same as the ninth cam of the second row, etc. Thus, the first row has a first cam group (5X–1X) and a second cam group (1Y–5Y), the second row has a corresponding first cam group (5Y–1Y) and a second cam group (1X–5X). The groups differ by the types of the cams such that no two cams on a given row are the same.

This arrangement results in causing a majority of the contact wires to perform sequential wipe cycles. As previously discussed, all of the contact wires are simultaneously brought into contact with the printed circuit board. Thereafter, due to the differing HIGH region lengths, contact wires abutting contact cams 1X and 1Y will complete their wipe cycles prior to those abutting contact cams 2X and 2Y, which will complete their wipe cycles prior to those abutting contact cams 3X and 3Y, etc. Thus, the wipe cycles completed by cams 1–5 are sequential, regardless of type; in other words, the sequence of the sequential wipe cycles is defined by the different lengths of the "low" regions. With reference to the rows of cams as shown in FIG. 5, it is apparent that the contact wires furthest removed from the center (e.g., cams 5) will complete their wipe cycles later than (and thus be sequential with respect to) those toward the center (e.g., cams 1). Thus, when a row of cams has two or more cam groups, the wipe cycles are "sequential" in the sense that the outer contacts complete their wipe cycles after the inner contacts. This relation could be reversed (i.e., the outer contacts could complete their wipe cycles before the inner ones do) by reversing the order of the cams along each row.

The above-described arrangement also achieves a balancing of forces which tends to promote the stability of the printed circuit board within the connector block. For example, consider cams 5X and 4Y of Row 1 and cams 5Y and 4X of Row 2 (see FIG. 5). As previously discussed, the wipe cycles imparted by the contact wires (via cams 4X of Row 2 and 4Y of Row 1) are staggered. In addition, the wipe cycles imparted via contact cams 5X and contact cams 4Y of Row 1 would also be staggered. Thus, in addition to the staggering of wipe cycles imparted by opposing cams, the present invention provides staggered wipe cycles to adjacent contact wires on the same row. It is to be noted that the rows of cams of the invention could have one, two, three, or more groups of cams. The specific composition of the groups of cams on each row may be varied. Further, the contact wires (and the staggering of the I/O pads) could be altered such that there are wires of three or more different lengths. Moreover, as previously stated, the invention works just as well with only one row of contacts.

In summary, the present invention provides means by which the contact wires of a ZIF connector can be modified to perform staggered wipe cycles on both sides of a printed circuit board. This result is achieved through the provision of a camming mechanism which is of relatively simple construction. Moreover, since the entire assembly could be manufactured from any one of a number of known nonconductive materials such as thermosetting resins, etc., the invention is relatively inexpensive to manufacture.

While the invention has been shown and described with reference to a preferred embodiment thereof, it will be understood by those skilled in the art that modifications to the structure and teachings disclosed herein may be made without departing from the spirit and scope of the invention.

We claim:

1. A zero insertion force type printed circuit board edge connector for establishing electrical contact between a plurality of contact pads disposed on at least one side of an edge of a printed circuit board and a plurality of electrical conductors, comprising:

a housing having a slot for receiving the edge of the printed circuit board;

a plurality of contacts connected through said housing to the plurality of electrical conductors and arranged into at least one row of contacts disposed within said slot; and first means mounted on said housing for moving said plurality of contacts into simultaneous abutment with the plurality of contact pads after the printed circuit board is inserted into said slot, a majority of adjacent ones of said plurality of contacts performing sequential wipe cycles on respective adjacent ones of the plurality of contact pads, adjacent ones of said plurality of contacts also performing staggered wipe cycles on respective adjacent ones of the plurality of contact pads.

2. An apparatus according to claim 1, wherein said housing comprises:

a lower housing, said plurality of contacts being mounted on said lower housing, said lower housing defining a guideway having a plurality of upward-facing cam followers;

a linear cam mounted for horizontal movement within said guideway, said linear cam having a plurality of downward-facing cam lobes; and an upper housing mounted on said linear cam, said upper housing substantially surrounding said plurality of contacts and defining said slot for receiving the edge of the printed circuit board;

wherein, during said horizontal movement of said linear cam, said plurality of downward-facing cam lobes abut said plurality of upward-facing cam followers to impart vertical movement to said upper housing.

3. An apparatus according to claim 2, wherein said first means comprises a plurality of cams mounted on said upper housing and arranged into at least one row of cams, each one of said plurality of cams abutting a respective one of said plurality of contacts.

4. An apparatus as recited in claim 3, wherein each one of said plurality of cams has a first region of a first width, a second region of a second width greater than said first width, a third region of a third width greater than said first width and less than said second width, and a fourth region of a fourth width greater than said third width and less than said second width.

5. An apparatus as recited in claim 4, wherein said second regions of said plurality of cams have different lengths, and wherein the sequence of said sequential wipe cycles of said plurality of contacts is defined by the lengths of said second regions of said plurality of cams.

6. An apparatus as recited in claim 4, wherein every other one of said plurality of contacts are of a first length and the others of said plurality of contacts are of a second length greater than said first length.

7. An apparatus as recited in claim 6, wherein said first regions of every other one of said plurality of cams are of a third length, and wherein said first regions of the others of said plurality of cams are of a fourth length less than said third length.

8. An apparatus as recited in claim 7, wherein the difference between said first and second lengths of said plurality of contacts is approximately equal to the difference between said third and fourth lengths of said first regions of said plurality of cams, and wherein said ones of said plurality of cams having first regions of said third length abut said ones of said plurality of contacts of said first length.

9. An apparatus as recited in claim 7, wherein the stagger of said staggered wipe cycles of said plurality of contacts is defined by (a) the lengths of said plurality of contacts and (b) the lengths of said first regions of said plurality of cams.

10. An apparatus as recited in claim 9, wherein adjacent ones of said plurality of contact pads are staggered with respect to one another.

11. A zero insertion force type printed circuit board edge connector for establishing electrical contact between a plurality of opposing contact pads disposed on both sides of an edge of a printed circuit board and a plurality of electrical conductors disposed on a base, comprising:

a lower housing mounted on the base, said lower housing defining a guideway having a plurality of upward-facing cam followers;

a slider mounted for horizontal movement along said guideway of said lower housing, said slider having a plurality of downward-facing cam lobes;

an upper housing mounted on said slider, said upper housing having an opening for receiving the edge of the printed circuit board;

a plurality of contacts connected through said lower housing to the plurality of electrical conductors, said plurality of contacts being arranged into two opposing rows of contacts disposed within said opening in said upper housing, said two opposing rows of contacts being substantially parallel to one another; and first means mounted on said upper housing for moving said two opposing rows of contacts into simultaneous abutment with the plurality of opposing contact pads, said first means causing a majority of adjacent ones of said plurality of contacts on each of said opposing rows of contacts to perform sequential wipe cycles on respective adjacent ones of said plurality of opposing contact pads, and causing adjacent and opposing ones of said plurality of contacts to perform staggered wipe cycles on respective adjacent and opposing ones of said plurality of opposing contact pads, said first means comprising a plurality of cams arranged into two opposing rows of cams mounted on said upper housing on either side of said slot of said upper housing, each one of said plurality of cams abutting a respective one of said plurality of contacts.

12. An apparatus as recited in claim 11, wherein each one of said plurality of cams has a first region of a first width, a second region of a second width greater than said first width, a third region of a third width greater than said first width and smaller than said second width, and a fourth region of a fourth width greater than said third width and less than said second width.

13. An apparatus as recited in claim 12, wherein said second regions of said plurality of cams have different lengths, and wherein said sequential wipe cycles of said plurality of contacts are defined by the length of said second regions of said plurality of cams.

14. An apparatus as recited in claim 12, wherein every other one of said plurality of contacts along each of said two opposing rows of contacts is of a first length, and the others of said plurality of contacts along each of said two opposing rows of contacts are of a second length greater than said first length.

15. An apparatus as recited in claim 14, wherein said first regions of said plurality of cams have different lengths, and wherein said staggered wipe cycles of said plurality of contacts are defined by both the lengths of said plurality of contacts and of cams.

16. An appartus as recited in claim 13, wherein each of said two oppositing rows of cams comprise first and second cam groups.

17. An apparatus as recited in claim 16, wherein the lengths of said second region of a first one of said plurality of cams of each of said cam groups is of a first length, said second region of a second of said plurality of cams of each of said cam groups is of a second length, said second length being less than said first length, said second region of a third one of said plurality of cams of each of said cam groups is of a third length, said third length being less than said second length, said second region of a fourth one of said plurality of cams of each of said cam groups is of a fourth length, said fourth length being less than said third length, and said second region of a fifth one of said plurality of cams of each of said cam groups is of a fifth length, said fifth length being less than said fourth length.

18. An apparatus as recited in claim 17, wherein each of said two opposing rows of cams comprises, in sequential order, said first one of said plurality of cams, said second one of said plurality of cams, said third one of said plurality of cams, said fourth one of said plurality of cams, said fifth one of said plurality of cams, said fifth one of said plurality of cams, said fourth one of said plurality of cams, said third one of said plurality of cams, said second one of said plurality of cams, and said first one of said plurality of cams.

19. An apparatus as recited in claim 15, wherein said first regions of adjacent ones of said plurality of cams alternate between a third length and a fourth length less than said third length, and wherein contacts of said first length abut respective ones of said cams having said first regions of said third length.

20. An apparatus as recited in claim 19, wherein each of said plurality of cams having said first regions of said third length are disposed immediately opposite from respective ones of said plurality of cams having said first regions of said fourth length.

21. A zero insertion force type printed circuit board edge connector for establishing electrical contact between a plurality of opposing contact pads disposed on both sides of an edge of a printed circuit board and a plurality of electrical conductors plated on a base, comprising:

a lower housing mounted on the base, said lower housing defining a guideway having a plurality of upward-facing cam followers;

a slider mounted for horizontal movement within said guideway of said lower housing, said slider having a plurality of downward-facing cam lobes which abut said upward facing cam followers;

an upper housing mounted on said slider, said upper housing having an opening for receiving the edge of the printed circuit board;

a plurality of contacts connected through said lower housing to the plurality of electrical conductors on the base and arranged into two opposing rows of contacts disposed within said opening, said two opposing rows of contacts being substantially parallel to one another and defining a plurality of opposing contact pairs, each of said plurality of opposing contact pairs having a first contact of a first length and a second contact of a second length greater than said first length, alternate ones of said plurality of contacts on each of said two opposing rows of contacts being of said first length; and first means mounted on said upper housing for moving said two opposing rows of contacts into simultaneous abutment with the plurality of opposing contact pads of the printed circuit board, said first means causing a majority of adjacent ones of said plurality of opposing contact pairs to perform sequential wipe cycles on respective adjacent ones of said plurality of opposing contact pads, and causing opposing and adjacent ones of said plurality of contacts within each of said plurality of opposing contact pairs to perform staggered wipe cycles on respective opposing and adjacent ones of said plurality of opposing contact pads, said first means comprising a plurality of cams arranged into two opposing rows mounted on said upper housing on either side of said slot, each one of said plurality of cams abutting a respective one of said plurality of contacts, wherein adjacent ones of said plurality of cams on each of said two opposing rows of cams have different surface profiles.

22. A zero insertion force type printed circuit board edge connector for establishing electrical contact between a plurality of electrical conductors, and a plurality of opposing contact pads disposed along both sides of an edge of a printed circuit board, comprising:

an insulating housing having an elongated slot for receiving the edge of the printed circuit board;

a plurality of contacts arranged into two substantially parallel rows of contacts connected through said housing to the plurality of electrical conductors and disposed within said slot on opposite sides thereof;

first means for moving said plurality of contacts into simultaneous engagement with the plurality of opposing contact pads, opposing ones of said plurality of contacts having differing lengths, said first means subsequently causing said opposing ones of said plurality of contacts to perform staggered wipe cycles on said contact pads and causing a majority of adjacent ones of said plurality of contacts to perform sequential wipe cycles on said contact pads, said means comprising a plurality of cams arranged into two opposing rows of cams disposed behind said two opposing rows of contacts, respectively, adjacent ones of said plurality of cams having different surface profiles; and second means for actuating first means.

23. An apparatus is recited in claim 22, wherein said surface profiles of each one of said plurality of cams are defined by at least first, second, third and fourth regions thereon, every other one of said plurality of cams on each of said two opposing rows of cams having first regions of a length greater than that of said first regions of the remaining ones of said plurality of cams, each of said two opposing rows of cams comprising first and second cam groups, said second regions of said plurality of cams in each of said cam groups having differing lengths.

24. An apparatus as recited in claim 23, wherein the stagger of said staggered wipe cycles is defined by (a) said differing lengths of said plurality of contacts and (b) said differing lengths of said first regions of said plurality of cams, and wherein the sequence of said sequential wipe cycles is defined by said differing lengths of said second regions of said plurality of cams.

25. An apparatus as recited in claim 24, wherein said two opposing rows of cams define a plurality of opposing cam pairs, said first regions of said cams of each of said plurality of cam pairs having different lengths.

26. A zero insertion force type printed circuit board edge connector for establishing electrical contact between a plurality of opposing staggered contact pads disposed on both sides of an edge of a printed circuit board and a plurality of electrical conductors plated on a base, comprising:

a lower housing mounted on the base, said lower housing defining a guideway having a plurality of upward-facing cam followers;

a slider mounted for horizontal movement within said guideway of said lower housing, said slider having a plurality of downward-facing cam lobes which abut said plurality of upward-facing cam followers within said guideway when said slider is moved horizontally;

an upper housing mounted for vertical movement on said slider, said upper housing having an opening for receiving the edge of the printed circuit board;

a plurality of contacts connected through said lower housing to the plurality of electrical conductors on the base, said plurality of contacts being arranged into two opposing rows of contacts disposed within said opening, said two opposing rows of contacts being substantially parallel to one another;

first means mounted on said upper housing for moving said two opposing rows of contacts into simultaneous abutment with the plurality of opposing contact pads, said first means causing a majority of adjacent ones of said plurality of contacts on each of said opposing rows of contacts to perform sequential wipe cycles on respective adjacent ones of said plurality of opposing contact pads, and causing opposing and adjacent ones of said plurality of contacts to perform staggered wipe cycles on respective opposing and adjacent ones of said plurality of opposing staggered contact pads, said first means comprising a plurality of cams arranged into two opposing rows of cams mounted on said upper housing and disposed behind said two opposing rows of contacts, respectively, each of said plurality of cams being disposed behind a respective one of said plurality of contacts, said plurality of cams having surface profiles defined by first, second, third, and fourth regions thereon, said cams comprising first and second types defined by said first regions thereon and first, second, third, fourth and fifth varieties defined by said second regions thereon, adjacent and opposing ones of said plurality of cams alternating between said first and second types, whereby the sequence of said sequential wipe cycles is defined by said variety of said plurality of cams and the stagger of said staggered wipe cycles is defined by said type of said plurality of cams.

* * * * *

UNITED STATES PATENT AND TRADEMARK OFFICE

CERTIFICATE OF CORRECTION

PATENT NO. : 4,542,950

DATED : September 24, 1985

INVENTOR(S) : John B. Gillett et al

It is certified that error appears in the above-identified patent and that said Letters Patent is hereby corrected as shown below:

Claim 17, line 61: After "second" and before "of said plurality" insert therefor --one--.

Signed and Sealed this

*Twenty-first* Day of *January 1986*

[SEAL]

*Attest:*

DONALD J. QUIGG

*Attesting Officer*

*Commissioner of Patents and Trademarks*